US005207407A

United States Patent [19]

Fitzsimmons et al.

[11] Patent Number: 5,207,407

[45] Date of Patent: May 4, 1993

[54] PORTABLE BASE FOR BASKETBALL BACKBOARD SUPPORT POLE

[75] Inventors: James N. Fitzsimmons; Michael A. Niver, both of Waukesha; David A. Allen, Pewaukee, all of Wis.

[73] Assignee: Huffy Corporation, Waukesha, Wis.

[21] Appl. No.: 721,187

[22] Filed: Jun. 26, 1991

[51] Int. Cl.[5] ..... F16M 13/00

[52] U.S. Cl. ..... 248/519; 248/346; 248/910; 273/1.5 R

[58] Field of Search ..... 248/346, 519, 520, 538, 248/910; 273/1.5 R, 1.5 A

[56] References Cited

U.S. PATENT DOCUMENTS

| | | | |
|---|---|---|---|
| Re. 25,938 | 12/1965 | Mobley | 229/7 |
| D. 264,740 | 6/1982 | Merino et al. | D21/201 |
| 1,043,387 | 11/1912 | Astruck . | |
| 1,270,004 | 6/1918 | Chappel . | |
| 1,570,403 | 1/1926 | Ripczinske . | |
| 1,631,227 | 6/1927 | See . | |
| 2,483,734 | 10/1949 | Neal | 40/125 |
| 2,818,254 | 12/1957 | Dunn | 273/1.5 |
| 2,916,184 | 12/1959 | Hartley et al. | 220/69 |
| 3,716,234 | 2/1973 | Lancellotti | 273/1.5 R |
| 3,841,631 | 10/1974 | Dolan | 273/1.5 R |
| 3,900,194 | 8/1975 | Ward et al. | 272/1 B |
| 3,908,992 | 9/1975 | Cunningham et al. | 273/55 R |
| 3,970,240 | 7/1976 | Van Leer | 229/22 |
| 4,145,044 | 3/1979 | Wilson et al. | 273/1.5 R |
| 4,286,409 | 9/1981 | Taylor et al. | 47/40.5 |
| 4,412,679 | 11/1983 | Mahoney et al. | 273/1.5 R |
| 4,613,136 | 9/1986 | Raba et al. | 273/1.5 R |
| 4,759,545 | 7/1988 | Grable | 273/1.5 R |
| 4,786,053 | 11/1988 | Barnes, Jr. | 273/1.5 R |
| 4,793,611 | 12/1988 | Thornell | 273/1.5 R |

FOREIGN PATENT DOCUMENTS

| | | | |
|---|---|---|---|
| 2234942 | 2/1973 | Fed. Rep. of Germany | 273/1.5 R |
| 0605246 | 5/1926 | France . | |

*Primary Examiner*—Ramon O. Ramirez

*Attorney, Agent, or Firm*—Michael, Best & Friedrich

[57] ABSTRACT

A base for a basketball support pole comprising, in combination, a plurality of walls arranged at an angle to each other and forming a polyhedron shaped body, support structure within the body defining an elongated opening extending into the body at an angle to the vertical and for receiving a support pole, structure for securing the pole in the opening against rotation about the elongated axis of the pole and against withdrawal from the opening, structure within the body defining a ballast receiving enclosure, and ballast within the ballast receiving enclosure.

12 Claims, 3 Drawing Sheets

PORTABLE BASE FOR BASKETBALL BACKBOARD SUPPORT POLE

BACKGROUND OF THE INVENTION

This invention relates to basketball backboard supports and, more particularly, to such supports as are portable.

Various types of basketball backboard supports have been proposed in the past. Such proposals have recognized that stability, and in some instances portability, are desirable characteristics. Obviously, stability and portability can present conflicting design considerations.

On playgrounds and at pool sides, for example, a portable backboard support is desirable. In such applications the ability to clear the support from the area, or to arrange a particular play area in a different configuration, are much sought-after attributes. This is even true to some degree in residential applications, although in those applications the supports are most commonly anchored in the ground in concrete or fixed to a structure such as a garage. Providing both stability and portability in a particular construction can also come at the price of acquiring overall a more involved structural arrangement, which means increasing complexity as well as increased cost.

One attempt at achieving portability and stability within a single support has been to incorporate some form of ballast in the support base. These and other prior ballast arrangements, however, have generally proved to be unacceptable due to the lack of sufficient stability in the final product, too much complexity, or both.

Among the general objects of this invention, then, is to provide a stable, portable support for a basketball backboard.

Another general object of this invention is to provide a simple and effective ballasted, portable, basketball backboard support.

A further general object of this invention is to provide a portable basketball backboard support which has an effective ballast arrangement for stability.

A still further general object of this invention is to provide such a support for a basketball backboard which additionally in operation is simple to relocate.

SUMMARY OF THE INVENTION

The invention provides a base for a basketball support pole comprising, in combination, a plurality of walls arranged at an angle to each other and forming a polyhedron shaped body, support means within the body defining an elongated opening extending into the body at an angle to the vertical and for receiving a support pole, means for securing the pole in the opening against rotation about the elongated axis of the pole and against withdrawal from the opening, means within the body defining a ballast receiving enclosure and ballast within the ballast receiving enclosure.

One embodiment of the invention provides a base for a basketball support pole comprising, in combination, a plurality of walls arranged at an angle to each other and forming a tetrahedron shaped body having a triangular base and three triangular sidewalls, preferably the tetrahedron body includes two separable sections, each section including plural walls arranged at an angle to each other, means for joining the two separable sections together to form the tetrahedron body, support means within the tetrahedron body defining an elongated opening extending into the body for receiving a support pole, the support means including a first portion attached to one of the separable sections and a second portion attached to the other of the separable sections, the first and second portions cooperating when the two separable sections are joined to provide secure connection of the pole in the base, means for securing the pole in the elongated opening against rotation about the elongated axis of the pole and against withdrawal from the opening, means within the body defining a ballast receiving enclosure, and ballast within the ballast receiving enclosure.

Another embodiment of the invention provides such a base wherein a cylindrical roller and roller fixing means are included. The cylindrical roller is located at the forward edge of the base opposite the pole support means, by the first separable section having a recessed portion along the edge of the base opposite the first support means portion, the second separable section having a recessed portion along the edge of the base opposite said second support means portion, and the recessed edges cooperating to form a gap when said separate sections are joined. The roller fixing means includes having an axle, the roller having a hole through its longitudinal axis, and the recessed portions of the separable sections having holes extending into the separable sections at their remote ends, wherein in assembly the axle extends through the roller, with the first and second portions cooperating when the two separable sections are joined to fix one of the ends of the axle within each of the holes in the recessed portions of the separable sections.

Other features and advantages of the invention will become apparent to those of ordinary skill in the art upon review of the following detailed description, claims, and drawings.

DETAILED DESCRIPTION OF THE PREFERRED EMBODIMENT

Figure 1:
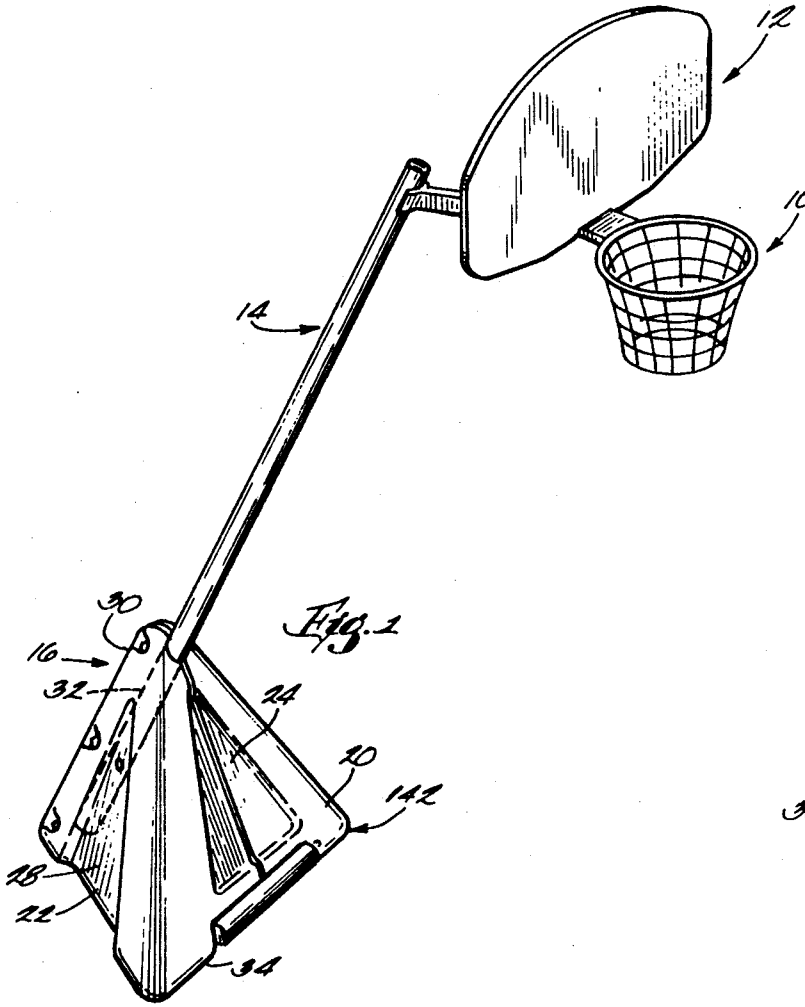
FIG. 1 is a schematic perspective view of the base of the invention in its contemplated use of supporting the pole for a basketball backboard.

FIG. 1 illustrates a basketball backboard, support pole and base, the base incorporating this invention in somewhat schematic form. Starting at the upper end, a conventional hoop and net 10 is attached to a backboard 12. A support pole 14 is suitably attached to backboard 12 in a conventional manner and extends from support base 16.

Base 16 is a polyhedron shaped, the lowest side or surface forming a base face 18 contacting the ground and upon which the entire assembled unit rests. Preferably, the base 16 is made in two sections 20 and 22 and is in the form of a tetrahedron having four sides. The base can be made in one piece, but the two-piece structure possesses certain advantages which will become apparent as this discussion continues. The four sides consist of the base face 18, a front face 24 and two side faces 26 and 28. The faces 18, 24, 26, and 28 of the assembled base are all triangular in shape when the preferred tetrahedral form is used.

The sections 20 and 22 abut along a plane which includes the edge 30, along which faces 26 and 28 are joined and which plane extends generally perpendicular to front face 24. That plane preferably divides the body into two identical sections 20 and 22. The interiors of each of the sections 20 and 22 are hollow and preferably watertight. The hollow interior provides means for receiving a suitable ballast material into the sections and, thus, into the base 16. The ballast material can be water, sand, or the like, but preferably water because of its ready availability and its ease of disposal.

Figure 2:
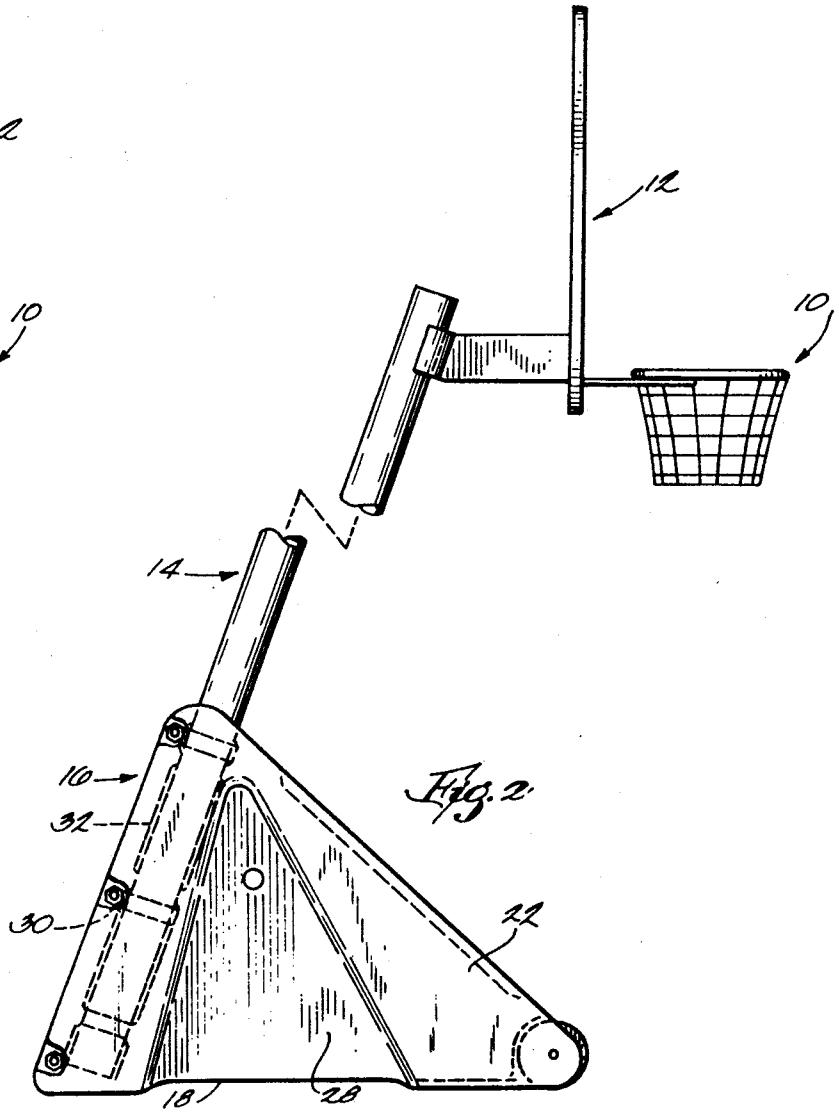
FIG. 2 is a side view of a fully assembled base.

The support pole 14 extends into the base 16 and is supported in an elongated opening 32 defined within the base (and shown by phantom lines in FIG. 2). The opening 32 is at an angle to the vertical so that when the pole 14 is inserted, it too is at an angle to the vertical. Preferably, the opening 32 extends generally parallel to the base edge 30. As will be explained more completely hereinafter, when the two sections 20 and 22 are joined, they form an opening 32 which includes means for securely grasping the pole 14. This means, not shown in either FIGS. 1 or 2, is effective to hold the pole against axial movement and also against rotation.

This arrangement overall provides a stable and yet readily portable apparatus for playing basketball.

More particularly, the footprint of the base 16 is such that the pole extends out over the forward edge 34 of the base 16. This provides a stable support for holding the pole and attached basketball backboard and hoop in an upright position. The support is such that it resists any tipping of the support pole forward, in the clockwise direction in FIGS. 1 and 2, during play, and maintains the hoop in an extended position out over and away from the forward edge 34 of the base 16 for unencumbered play beneath the backboard and hoop. The use of the ballast within the separable sections 20 and 22, and thus in base 16, further increases the stability of both the base 16 and the attendant playing attachments.

Also, the pole 14 being at an angle to the vertical, although it will result in loading the pole somewhat in a bending mode, i.e., the weight of the pole, backboard, and attendant attachments tending to bend the pole 14 in a clockwise direction, it is also loaded in compression. The loading and compression is along the longitudinal axis of pole 14 and this compression loading reduces the tendency of the pole and backboard assembly to wave.

Preferably, the support means 32 and pole 14 are arranged at an angle of approximately 20° to the vertical.

A preferred structural embodiment of the base incorporating this invention is illustrated in FIGS. 3–12.

In the preferred embodiment, the sidewalls 36, 38, and 40 and the base 42 are not straight planar sections as illustrated in FIGS. 1 and 2. In the preferred embodiment seen in FIGS. 3–6, it is seen that the sidewalls, although maintaining the triangular shape, are somewhat indented. The indented configuration is desired for aesthetics and to lend rigidity to the sidewalls and base. The indentation provides recessed surfaces 44 and 46, an additional recessed surface 47 on the remaining side face not shown in FIG. 3. These surfaces are joined to the principal planar faces of the triangular sidewalls by a series of smaller walls, 48 and 50 with respect to side face 44, and 52 and 54 with respect to forward face 46. An arrangement similar to that on recess 44 is provided on side face 47 not visible in FIG. 3. The recesses provide aesthetic features as well as improving the mechanical strength of the sidewalls. The bottom or resting face 55, again not visible in FIG. 3, also has recesses.

Figure 5:
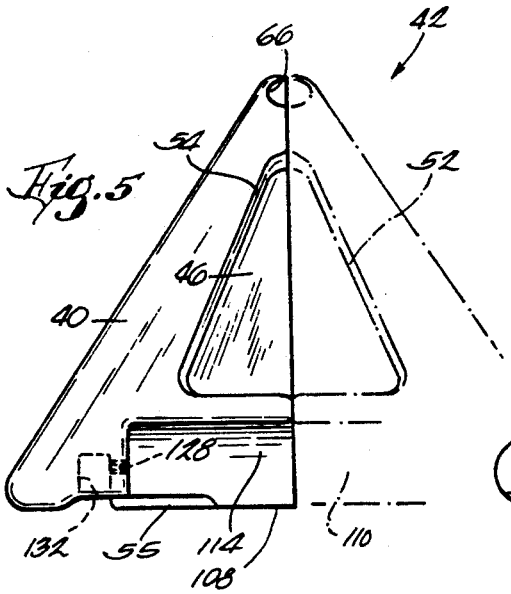
FIG. 5 is a front view of the base section of FIG. 4 with broken lines disclosing the roller attachment area.
Figure 4:
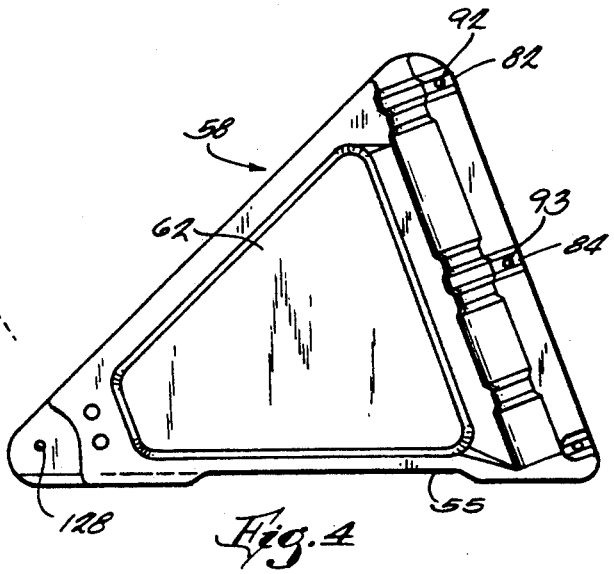
FIG. 4 is a side view of the base, viewing the inside surface of an unassembled base section.
Figure 6:
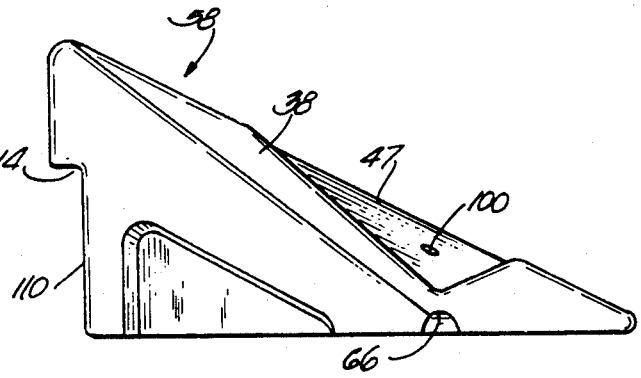
FIG. 6 is a top view of base section of FIG. 4.

The actual base is formed by two separable sections 56 and 58 which, in the preferred embodiment, are identical mirror images of one another (FIGS. 4–6). Sections 56 and 58 include inner walls 60 and 62 which are in a plane which is generally perpendicular to the triangular face forming the base, and extend through the edge 64 along which triangular faces 44 and 47 are joined.

Figure 7:
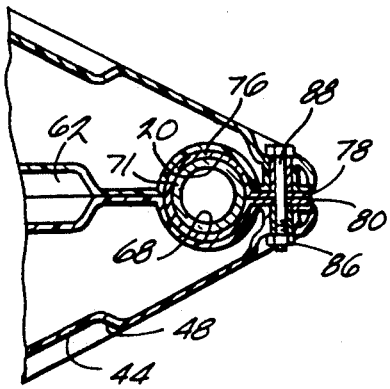
FIG. 7 a view of the area of pole attachment showing the workings of the clamp assembly, viewed along line 7—7 of FIG. 3.
Figure 3:
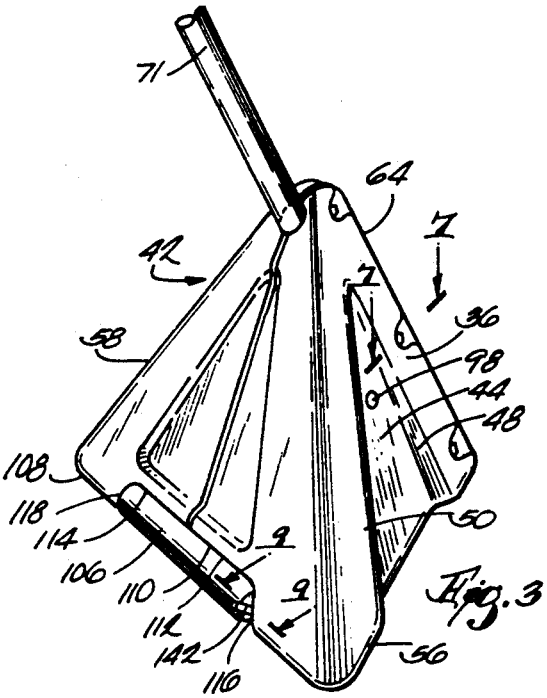
FIG. 3 is a perspective view of an assembled base.

With reference to FIG. 7, the elongated opening 66 is formed in the base by two mating surfaces, one on section 56 and one on section 58. These mating surfaces 68 and 70 are semi-circular in cross section and are arranged with their axes parallel to edge 64 such that when sections 56 and 58 are brought together, they define an elongated tubular opening (see FIG. 4) extending parallel to edge 64. Pole 71 can be received in the opening defined by the two sections 68 and 70 when they are suitably joined in abutting relationship.

Figure 8:
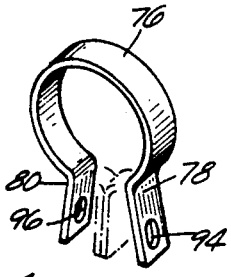
FIG. 8 a perspective view of the pole clamp.
Figure 12:
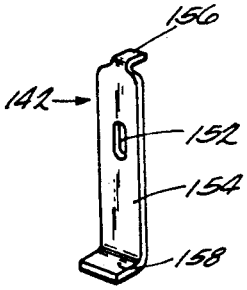
FIG. 12 is a perspective view of the locking clip.

With respect to joining the separable sections 56 and 58, two clamps 72 and 74 are provided. One such clamp is shown in FIG. 8 separated from the base. The clamp is made of spring material, preferably rolled steel, and has a generally circular body 76 and two radially extending arms 78 and 80 at the ends of body 76. The normal configuration of a clamp is illustrated by the full lines in FIG. 8. When the sections 56 and 58 are to be joined together, one clamp 72 is placed in area 82 and the other in area 84 and as the sections are brought together, the arms 78 and 80 are moved to the dotted line position shown in FIG. 8. The pole 71 will have been (FIG. 10}previously positioned in the body 76 of a clamp so that as the sections 56 and 58 are brought together and arms 78 and 80 are correspondingly brought together, the area circumscribed by body 76 is reduced and firmly clamps around the pole. When the two 56 and 58 sections are in their final position, i.e., their final assembled position, a suitable nut 86 and 87 and bolt 88 and 89 arrangement is inserted through openings 90, 91, 92 and 93 in sections 56 and 58 and through openings 94 and 96 in the closed arms 78 and 80, and both the base sections 56 and 58 and the clamp arms 78 and 80 are secured in position, holding the pole 71 in the desired orientation.

Fill holes 98 and 100 (FIGS. 3 and 6) are provided in sidewalls 102 and 104 of sections 56 and 58. These holes provide the means through which the ballast can be introduced into the interior of sections 56 and 58. It will be noted from the drawings that the interior of both sections 56 and 58 are hollow, forming compartments which generally follow the configuration of the tetrahedron base.

With the ballast in place, the base, backboard, and hoop are ready for play.

Figure 11:
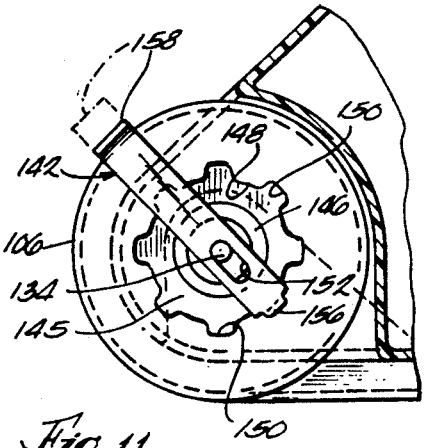
FIG. 11 is a view of the roller locking clip and assembly taken along view 11—11 of FIG. 9 and demonstrating the locking action.
Figure 9:
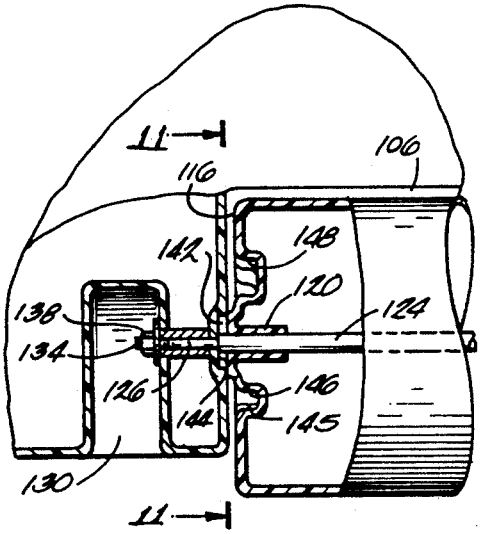
FIG. 9 is a view taken along line 9—9 of FIG. 3 showing the attachment of the roller to the base.
Figure 10:
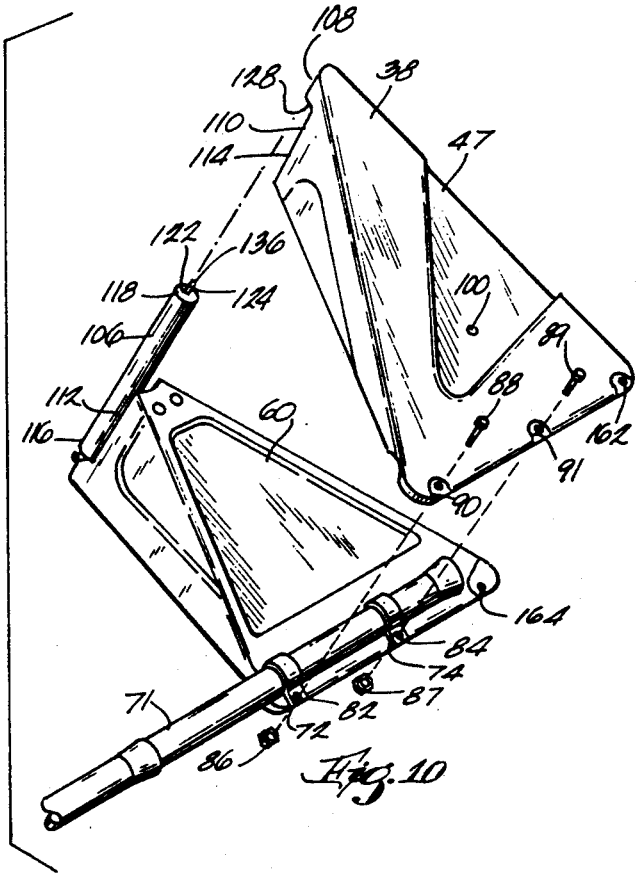
FIG. 10 is a perspective view demonstrating the mode of assembly of the roller.

If desired, a roller 106 can be included in base 42, along forward edge 108 where forward face 46 and resting face 55 meet. A recessed portion 110 in forward edge 108 is provided, formed by adjacent recessed portions 112 and 114 of sections 56 and 58. The roller 106, as seen in FIG. 9, is generally cylindrical and hollow, with opposite ends 116 and 118. Ends 116 and 118 have small openings 120 and 122 (FIGS. 9–11). An axle 124 extends through both openings and through small openings 126 and 128 located (FIGS. 5 and 9) at the ends of the recessed portions 112 and 114. The separable sections 56 and 58 also have (FIGS. 5 and 9) small indentations 130 and 132 which push up from the bottom of the base 55 and provides a space for affixing the axle ends 134 and 136 and securing the axle in place. Small nuts are used to affix to the threaded axle ends, FIG. 9 depicting such an arrangement with axle end 134 and nut 138.

In assembling the roller (FIG. 10) the base is laid on the ground and roller axle 124 is passed through hole 126 in recess 112 of separable section 56, and secured within indentation 130 by nut 138 onto threaded axle end 134. A locking clip 142 is placed over the axle and slid down until it lodges in a molded depression 144 about hole 126. The roller 106 is then passed over axle 124, threading axle 124 through the holes 120 and 122 at the roller ends 116 and 118. Before assembling section 58 towards section 56, a second locking clip (not depicted) can optionally be fitted over axle end 136 and which would rest against roller end 118 until section 58 is brought down.

As seen in FIGS. 9 and 11, the roller ends each have a unique configuration, end 116 depicted with a depression 145 encircling opening 122. (The opposite end 118 of roller 106 is similar and is not depicted in detail). Depression 145 has a smooth inner wall 146 towards the roller axis, and an outer wall 148 which has regularly repeating outpocketings 150, wherein the distance from inner wall 146 is increased for a certain circumferential distance. This gives outer wall 148 a toothed or sprocketed appearance (FIG. 11).

Locking clip 142 has an offset hole 152 which is positioned over axle 124 in assembly (FIG. 11). The clip 142 (FIG. 12) has a longitudinal axis with a flat strip portion 154, preferably of hardened steel. It also has ends 156 and 158, which are additionally bent perpendicular to the plane of the flat strip portion 154, with one bent end 156 reduced in width. The clip 142 is positioned (FIG. 11) over axle 124 so that the reduced end 156 falls within depression 145 in end 116.

As section 58 is placed over section 56, threaded axle end 136 passes through hole 128 in recessed portion 114, and is fixed within indentation 132 by a nut (not depicted). Molded depression 144 (FIG. 9}about opening 126 in recess portion 112 now firmly fixes the strip portion 154 of the clip 142. Roller end 116 holds clip 142 against depression 144. Clip 142 is movable relative to depression 144 along its longitudinal axis, but is held by depression 144 against rotational movement about roller axis 124.

Hole 152 in clip 142 is elongated, and permits (FIG. 11) the relative longitudinal movement of locking clip 142 within depression 145. In the locking position, indicated by solid lines in FIG. 11, the small bent end 156 of clip 142 occupies one of the outpocketings 150 of depression 145 of roller end 116, and holds roller 106 against rotation about axle 124. Pulling the pin out to the position indicated by dotted lines in FIG. 11 pulls the small bent end 156 out of the previously occupied outpocketing 152 and into the main body of depression 145. In this position, clip 142 does not oppose rotation of roller 106 about axle 124.

In this way, roller 106 is supported at the broad edge 108 of the base over which the basketball support pole 71 extends, nd the roller assembly itself assists in holding the two separate sections 56 and 58 together. Placing the roller along the broad edge 108, over which the basketball pole 71 and backboard and hoop extend, contributes to the ease of moving the entire assembly by means of the roller.

A pair of aligned openings 162 and 164 are provided FIG. 10) in base sections 56 and 58 near the bottom of joined edge 64. A suitable nut and bolt arrangement can be used here to affix a stake, chain or other suitable means (not shown) for securing the back end of base 42 against movement.

Although but one embodiment of the present invention has been illustrated and described, it will be apparent to those skilled in the art that various changes and modifications may be made therein without departing from the spirit of the invention or from the scope of the appended claims.

We claim

1. A base for a basketball support pole comprising, in combination, a plurality of walls arranged at an angle to each other and forming a tetrahedron shaped body having a triangular base and three triangular sidewalls, said tetrahedron body including two separable sections, each section including plural walls arranged at an angle to each other, means for joining said two separable sections together to form said tetrahedron body, support means within said tetrahedron body defining an elongated opening extending into said body for receiving a support pole, said support means including a first portion attached to one of said separable sections and a second portion attached to the other of said separable sections, said first and second portions cooperating when said two separable sections are joined to provide secure connection of said pole in said base, means for securing said pole in said elongated opening against rotation about the elongated axis of said pole and against withdrawal from said opening, means within said body defining a ballast receiving enclosure, and ballast within said ballast receiving enclosure.

2. The base of claim 1 wherein said elongated opening is arranged at an angle to the vertical and extends generally parallel to one of the edges along which the triangular shaped walls are joined.

3. The base of claim 2 wherein said opening is arranged at approximately 20° to the vertical.

4. The base of claim 1 wherein the support means positions the support pole in an angular direction out and over said polyhedron shape body.

5. A base for a basketball support pole comprising, in combination, a plurality of walls arranged at an angle to each other and forming a tetrahedron shaped body, support means within said tetrahedron shaped body defining an elongated opening extending into said body for receiving a support pole, means for securing said pole in said elongated opening against rotation about the elongated axis of said pole and against withdrawal from said opening, means within said body defining a ballast receiving enclosure, and ballast within said ballast receiving enclosure.

6. A base for a basketball support pole comprising, in combination, a plurality of walls arranged at an angle to each other and forming a polyhedron shaped body, said polyhedron shaped body including two separable sections, each section including plural walls arranged at an angle to each other, means for joining said two separable sections together to form said polyhedron shaped body, support means within said body defining an elongated opening extending into said body at an angle to the vertical and for receiving a support pole, said support means within said body including first portion attached to one of said separable sections and a second portion attached to the other of said separable sections, said first and second portions cooperating when said two separable sections are joined to provide secure connection of said pole in said base opening against rotation about the elongated axis of said pole and against withdrawal from said opening, means within said body defining a ballast receiving enclosure, said walls defining said ballast receiving enclosure, the configuration of said ballast receiving enclosure approximating the shape of said polyhedron shaped body, and each of said separable sections defining an interior ballast receiving enclosure, and ballast within said ballast receiving enclosure, including ballast in each of said separable sections.

7. The base of claim 6 wherein said polyhedron body is a tetrahedron having a triangular shaped base and three triangular shaped side walls, said elongated pole receiving opening extends generally parallel to one of the edges along which the triangular shaped side walls are joined, and said tetrahedron body is divided into said two separable sections by a plane extending through said one edge and generally normal to the side wall opposite said one edge.

8. The base of claim 7 wherein the angle of said elongated opening to the vertical is approximately 20°.

9. The base of claim 8 including means for rolling said base, wherein said first separable section has a recessed portion along the edge of said base opposite said first support means portion, said second separable section has a recessed portion along the edge of said base opposite said second support means portion, said recessed edges cooperate to form a gap when said separate sections are joined, and means are provided for fixing said rolling means within said gap.

10. The base of claim 9 wherein said rolling means is a cylindrical roller.

11. The base of claim 10 wherein said roller fixing means includes, an axle, said roller including a hole through its longitudinal axis, said recessed portions including holes extending into the base at their remote ends, and said axle extending through said roller and said first and second portions cooperating when said two separable sections are joined to fix one end of said axel within each of said holes within said recessed portions.

12. The base of claim 11 wherein means are provided for locking said roller against rotation about said axle.

* * * * *